US008428941B2

(12) United States Patent
Boehm et al.

(10) Patent No.: US 8,428,941 B2
(45) Date of Patent: Apr. 23, 2013

(54) METHOD AND APPARATUS FOR LOSSLESS ENCODING OF A SOURCE SIGNAL USING A LOSSY ENCODED DATA STREAM AND A LOSSLESS EXTENSION DATA STREAM

(75) Inventors: Johannes Boehm, Goettingen (DE); Peter Jax, Hannover (DE); Florian Keiler, Hannover (DE); Oliver Wuebbolt, Hannover (DE); Sven Kordon, Hannover (DE)

(73) Assignee: Thomson Licensing, Issy-les-Moulineaux (FR)

( * ) Notice: Subject to any disclaimer, the term of this patent is extended or adjusted under 35 U.S.C. 154(b) by 1205 days.

(21) Appl. No.: 12/226,992

(22) PCT Filed: Apr. 18, 2007

(86) PCT No.: PCT/EP2007/053783

§ 371 (c)(1),
(2), (4) Date: Nov. 4, 2008

(87) PCT Pub. No.: WO2007/128661

PCT Pub. Date: Nov. 15, 2007

(65) Prior Publication Data

US 2009/0164226 A1 Jun. 25, 2009

(30) Foreign Application Priority Data

May 5, 2006 (EP) ..... 06113576

(51) Int. Cl.
*G10L 19/00* (2006.01)
*G10L 19/12* (2006.01)
*G10L 19/02* (2006.01)

(52) U.S. Cl.
USPC ..... 704/230; 704/219; 704/222; 704/229; 704/500

(58) Field of Classification Search ..... 704/219, 704/229, 500
See application file for complete search history.

(56) References Cited

U.S. PATENT DOCUMENTS 5,699,484 A 12/1997 Davis ..... 704/200.1
6,498,811 B1 12/2002 Van Der Vleuten ..... 375/240

(Continued)

FOREIGN PATENT DOCUMENTS

DE 19742201 2/1999
DE 19742201 C1 2/1999

(Continued)

OTHER PUBLICATIONS

Rongshan Yu; Xiao Lin; Rahardja, S.; Ko, C.C.; , "A scalable lossy to lossless audio coder for MPEG-4 lossless audio coding," Acoustics, Speech, and Signal Processing, 2004. Proceedings. (ICASSP '04). IEEE International Conference on , vol. 3, No., pp. iii-1004-7 vol. 3, May 17-21, 2004 doi: 10.1109/ICASSP.2004.1326717.

(Continued)

*Primary Examiner* — Pierre-Louis Desir
*Assistant Examiner* — Matthew Baker
(74) *Attorney, Agent, or Firm* — Myers Wolin, LLC

(57) ABSTRACT

In lossy based lossless coding a PCM audio signal passes through a lossy encoder to a lossy decoder. The lossy encoder provides a lossy bit stream. The difference signal between the PCM signal and the lossy decoder output is lossless encoded, providing an extension bit stream. The invention facilitates enhancing a lossy perceptual audio encoding/decoding by an extension that enables mathematically exact reproduction of the original waveform using enhanced de-correlation, and provides additional data for reconstructing at decoder site an intermediate-quality audio signal. The lossless extension can be used to extend the widely used mp3 encoding/decoding to lossless encoding/decoding and superior quality mp3 encoding/de-coding.

13 Claims, 5 Drawing Sheets

U.S. PATENT DOCUMENTS

Figure 1:
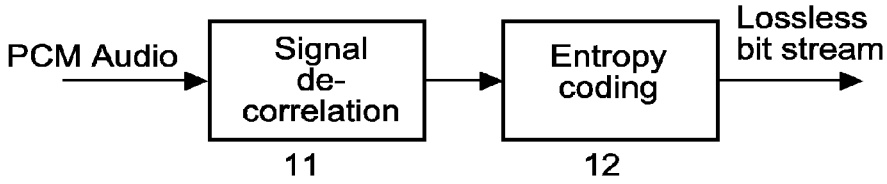
Fig.1 (Prior Art)

| | | | | |
|---|---|---|---|---|
| 6,593,872 | B2 * | 7/2003 | Makino et al. | 341/200 |
| 6,675,148 | B2 | 1/2004 | Hardwick | 704/500 |
| 7,224,747 | B2 | 5/2007 | Rijnberg et al. | 375/296 |
| 7,275,036 | B2 | 9/2007 | Geiger et al. | 704/500 |
| 7,392,195 | B2 | 6/2008 | Fejzo | 704/500 |
| 7,464,027 | B2 | 12/2008 | Schuler et al. | |
| 7,617,097 | B2 | 11/2009 | Kim et al. | 704/219 |
| 7,813,932 | B2 | 10/2010 | Kim et al. | 704/500 |
| 7,835,904 | B2 | 11/2010 | Li et al. | 704/200.1 |
| 8,055,500 | B2 | 11/2011 | Kim et al. | 704/229 |
| 8,069,040 | B2 * | 11/2011 | Vos | 704/222 |
| 8,121,831 | B2 | 2/2012 | Oh et al. | 704/219 |
| 2002/0087304 | A1 | 7/2002 | Kjorling et al. | 704/219 |
| 2004/0044520 | A1 | 3/2004 | Chen et al. | 704/200.1 |
| 2004/0054529 | A1 | 3/2004 | Sung et al. | 704/229 |
| 2005/0114126 | A1 | 5/2005 | Geiger et al. | 704/230 |
| 2006/0015329 | A1 | 1/2006 | Chu | 704/219 |
| 2007/0208557 | A1 | 9/2007 | Li et al. | 704/200.1 |
| 2008/0243518 | A1 | 10/2008 | Oraevsky et al. | 704/500 |
| 2010/0262420 | A1 | 10/2010 | Herre et al. | 704/201 |

FOREIGN PATENT DOCUMENTS

| | | | |
|---|---|---|---|
| JP | 11109996 | A | 4/1999 |
| JP | 2007522509 | A | 8/2007 |

OTHER PUBLICATIONS

Moriya, T.; Iwakami, N.; Jin, A.; Mori, T.; , "A design of lossy and lossless scalable audio coding," Acoustics, Speech, and Signal Processing, 2000. ICASSP '00. Proceedings. 2000 IEEE International Conference on , vol. 2, No., pp. II889-II892 vol. 2, 2000 doi: 10.1109/ICASSP.2000.859103.

Geiger, R.; Herre, A.; Schuller, G.; Sporer, T.; , "Fine grain scalable perceptual and lossless audio coding based on IntMDCT," Acoustics, Speech, and Signal Processing, 2003. Proceedings. (ICASSP '03). 2003 IEEE International Conference on , vol. 5, No., pp. V-445-8 vol. 5, Apr. 6-10, 2003 doi: 10.1109/ICASSP.2003.1200002.

Tilman Liebchen and Yuriy A. Reznik. MPEG-4 ALS: an emerging standard for lossless audio coding. Data Compression Conference. Apr. 3, 2004.

Liebchen, Tilman. MPEG-4 Lossless Coding for High-Definition Audio. Affiliation: Technical University of Berlin, Germany AES Convention:115 (Oct. 2003) Paper No. 5872.

Liebchen, Tilman; Reznik, Yuriy A. Improved Forward-Adaptive Prediction for MPEG-4 Audio Lossless Coding. Affiliations: RealNetworks, Inc.; Technical University of Berlin. AES Convention:118 (May 2005) Paper No. 6449.

Tilman Liebchen, Takehiro Moriya, Noboru Harada, Yutaka Kamamoto, and Yuriy A. Reznik. The MPEG-4 Audio Lossless Coding (ALS) Standard—Technology and Applications. Audio Engineering Society Convention Paper Presented at the 119th Convention. Oct. 7-10, 2005 New York, NY, USA.

Yu, R.; Ko, C.C.; Rahardja, S.; Lin, X.; , "Bit-plane Golomb coding for sources with Laplacian distributions," Acoustics, Speech, and Signal Processing, 2003. Proceedings. (ICASSP '03). 2003 IEEE International Conference on , vol. 4, No., pp. IV-277-80 vol. 4, Apr. 6-10, 2003.*

K. Adistambha et al.: "An Investigation into Embedded Audio Coding using an AAC Perceptually Lossless Base Layer" Proceedings of the Australian Int'l Conference on Speech Science and Technology, Dec. 8, 2004, pp. 227-230.

A. Jin et al. "Scalable audio coder based on quantizer units of MDCT coefficients" Acoustics, Speech and Signal Processing 1999, IEEE Int'l Conf. Mar. 15-19, 1999, vol. 2, pp. 897-900 XP010328465.

A. Jin et al "A Hierarchical Lossless/Lossy Coding System for High Quality Audio up to 192 KHZ Sampling 24 Bit Format", IEEE Transactions on Consumer Electronics, New York, NY US. vol. 49, No. 3, Aug. 2003, pp. 759-764.

Search Report Dated Jun. 19, 2007.

* cited by examiner

METHOD AND APPARATUS FOR LOSSLESS ENCODING OF A SOURCE SIGNAL USING A LOSSY ENCODED DATA STREAM AND A LOSSLESS EXTENSION DATA STREAM

This application claims the benefit, under 35 U.S.C. §365 of International Application PCT/EP2007/053783, filed Apr. 18, 2007, which was published in accordance with PCT Article 21(2) on Nov. 15, 2007 in English and which claims the benefit of European patent application No. 06113576.0, filed May 5, 2006.

The invention relates to a method and to an apparatus for lossless encoding of a source signal, using a lossy encoded data stream and a lossless extension data stream which together form a lossless encoded data stream for said source signal. Lossy perceptual audio coding data are enhanced by extension data that enable mathematically exact (lossless) reproduction of the original audio signal waveform.

BACKGROUND

The basic principle of lossless audio coding is depicted in FIG. 1. The digital PCM Audio signal samples are not independent to each other. A signal de-correlation 11 is used to reduce this dependency before entropy coding 12. This process needs to be reversible, to be able to restore the original signal. Known de-correlation techniques are using Linear Predictive Filtering (also known as Linear Predictive Coding LPC), integer filter-banks and lossy based approaches.

Figure 2:
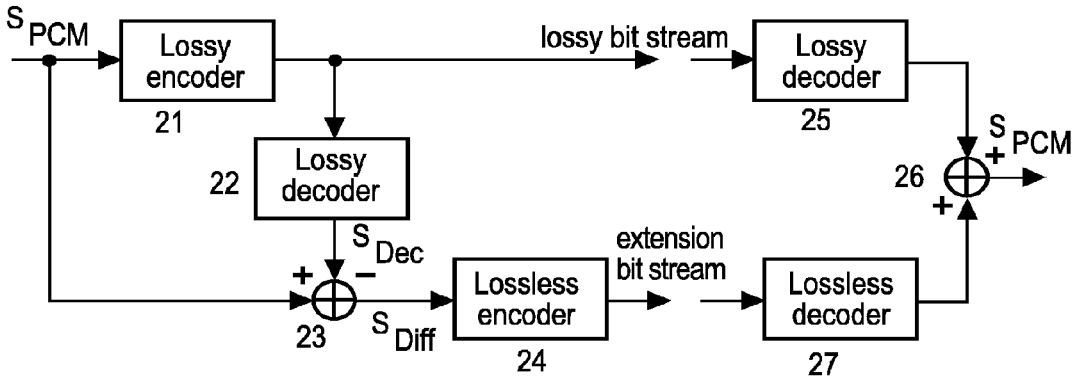
Fig.2 (Prior Art)
Figure 3:
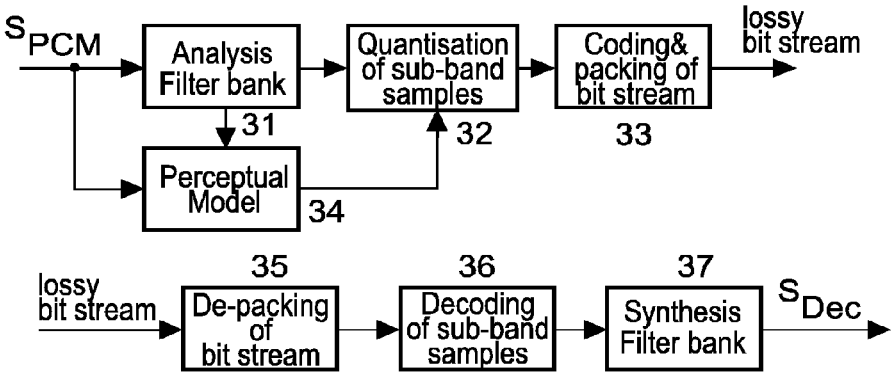
Fig.3 (Prior Art)

The basic principle of lossy based lossless coding is depicted in FIG. 2 and FIG. 3. In the encoding part (left side) in FIG. 2, a PCM audio input signal $S_{PCM}$ passes through a lossy encoder 21 to a lossy decoder 22 and as a lossy bit stream to a lossy decoder 25 in the decoding part (right side). Lossy encoding and decoding is used to decorrelate the signal. The output signal of decoder 22 is removed from the input signal $S_{PCM}$ in a subtractor 23, and the resulting difference signal passes through a lossless encoder 24 as an extension bit stream to a lossless decoder 27. The output signals of the decoders 25 and 27 are combined 26 so as to regain the original signal $S_{PCM}$.

This basic principle is disclosed for audio coding in EP-B-0756386 and U.S. Pat. No. 6,498,811, and is also discussed in P. Craven, M. Gerzon, "Lossless Coding for Audio Discs", J. Audio Eng. Soc., Vol. 44, No. 9, Sep. 1996, and in J. Koller, Th. Sporer, K. H. Brandenburg, "Robust Coding of High Quality Audio Signals", AES103rd Convention, Preprint 4621, Aug. 1997.

In the lossy encoder in FIG. 3, the PCM audio input signal $S_{PCM}$ passes through an analysis filter bank 31 and a quantisation 32 of sub-band samples to a coding and bit stream packing 33. The quantisation is controlled by a perceptual model calculator 34 that receives signal $S_{PCM}$ and corresponding information from the analysis filter bank 31. At decoder side, the encoded lossy bit stream enters a means 35 for de-packing the bit stream, followed by means 36 for decoding the subband samples and by a synthesis filter bank 37 that outputs the decoded lossy PCM signal $S_{Dec}$. Examples for lossy encoding and decoding are described in detail in the standard ISO/IEC 11172-3 (MPEG-1 Audio).

Because a lossy encoder produces an error signal $S_{Diff}$ that is proportional to the masking thresholds in the frequency domain, the signal is not very well de-correlated and therefore sub-optimum for entropy coding. As a consequence, the following publications focus on a special handling of the error signal $S_{Diff}$. The common approach is to apply variations of LPC de-correlation schemes to the error signal $S_{Diff}$: WO-A-9953677, U.S. Pat. No. 20040044520, WO-A-2005098823. In EP-A-0905918 the amplitude of the error signal $S_{Diff}$ is used with a feedback loop to the quantisation stage of the lossy encoder part in order to control the quantisation in the lossy encoder and thus to generate a better de-correlation of the error signal $S_{Diff}$.

INVENTION

When providing a lossless coding extension for lossy coding it is desirable to facilitate this in a scalable manner.

A problem to be solved by the invention is to provide an improved lossless coding/decoding extension for lossy coding/decoding in a scalable manner, the lossy coding/decoding being based for example on mp3 (MPEG-1 Audio Layer 3). This problem is solved by the encoding method disclosed in claim 1 and the decoding methods in claims 3 and 5. Apparatuses that utilise these method are disclosed in claims 2, 4 and 6, respectively.

The invention facilitates enhancing a lossy perceptual audio encoding/decoding by an extension that enables mathematically exact reproduction (i.e. lossless encoding/decoding) of the original waveform. The lossy based lossless coding makes use of enhanced de-correlation by means of spectral de-correlation build into the lossy encoder-decoder and additional temporal LPC de-correlation, where the LPC filter parameters need not be transmitted.

Advantageously, the inventive lossless extension can be used to extend the widely used mp3 encoding/decoding to lossless encoding/decoding.

In principle, the inventive encoding method is suited for lossless encoding of a source signal, using a lossy encoded data stream and a lossless extension data stream which together form a lossless encoded data stream for said source signal, said method including the steps:

- lossy encoding said source signal, wherein said lossy encoding provides said lossy encoded data stream as well as spectral whitening data;
- correspondingly lossy decoding said lossy encoded data, thereby reconstructing a standard decoded signal and, using said spectral whitening data, constructing from said standard decoded signal a superior quality decoded signal;
- forming a difference signal between said source signal and said superior quality decoded signal and lossless encoding said difference signal;
- packing said encoded difference signal together with said spectral whitening data to form said lossless extension data stream.

In principle the inventive encoding apparatus is suited for lossless encoding of a source signal, using a lossy encoded data stream and a lossless extension data stream which together form a lossless encoded data stream for said source signal, said apparatus including:

- means being adapted for lossy encoding said source signal, wherein said lossy encoding provides said lossy encoded data stream as well as spectral whitening data;
- means being adapted for correspondingly lossy decoding said lossy encoded data, thereby reconstructing a standard decoded signal and, using said spectral whitening data, for constructing from said standard decoded signal a superior quality decoded signal;
- means being adapted for forming a difference signal between said source signal and said superior quality decoded signal and for lossless encoding said difference signal and for packing said encoded difference signal together with said spectral whitening data to form said lossless extension data stream.

In principle, the inventive decoding method is suited for decoding a lossless encoded source signal data stream, which data stream was derived from a lossy encoded data stream and a lossless extension data stream which together form a lossless encoded data stream for said source signal, wherein said source signal was lossy encoded, said lossy encoding providing said lossy encoded data stream as well as spectral whitening data, and wherein said lossy encoded data were correspondingly lossy decoded, thereby reconstructing a standard decoded signal and, using said spectral whitening data, a superior quality decoded signal was constructed from said standard decoded signal, and wherein a difference signal between said source signal and said superior quality decoded signal was formed and lossless encoded, and wherein said lossless encoded difference signal was packed together with said spectral whitening data to form said lossless extension data stream, said method including the steps:

de-packing said lossless extension data stream and decoding said lossless encoded difference signal so as to provide said difference signal and said spectral whitening data;

lossy decoding said lossy encoded data stream, thereby reconstructing said standard decoded signal and, using said spectral whitening data, reconstructing said superior quality decoded signal from said standard decoded signal;

forming from said decoded lossless encoded difference signal and from said superior quality decoded signal a reconstructed source signal.

In principle the inventive decoding apparatus is suited for for decoding a lossless encoded source signal data stream, which data stream was derived from a lossy encoded data stream and a lossless extension data stream which together form a lossless encoded data stream for said source signal, wherein said source signal was lossy encoded, said lossy encoding providing said lossy encoded data stream as well as spectral whitening data, and wherein said lossy encoded data were correspondingly lossy decoded, thereby reconstructing a standard decoded signal and, using said spectral whitening data, a superior quality decoded signal was constructed from said standard decoded signal, and wherein a difference signal between said source signal and said superior quality decoded signal was formed and lossless encoded, and wherein said lossless encoded difference signal was packed together with said spectral whitening data to form said lossless extension data stream, said apparatus including:

means being adapted for de-packing said lossless extension data stream and for decoding said lossless encoded difference signal so as to provide said difference signal and said spectral whitening data;

means being adapted for lossy decoding said lossy encoded data stream, thereby reconstructing said standard decoded signal and, using said spectral whitening data, reconstructing said superior quality decoded signal from said standard decoded signal;

means being adapted for forming from said decoded lossless encoded difference signal and from said superior quality decoded signal a reconstructed source signal.

In principle, the further inventive decoding method is suited for decoding a lossless encoded source signal data stream, which data stream was derived from a lossy encoded data stream and a lossless extension data stream which together form a lossless encoded data stream for said source signal, wherein said source signal was lossy encoded, said lossy encoding providing said lossy encoded data stream as well as spectral whitening data, and wherein said lossy encoded data were correspondingly lossy decoded, thereby reconstructing a standard decoded signal and, using said spectral whitening data, a superior quality decoded signal was constructed from said standard decoded signal, and wherein a difference signal between said source signal and said superior quality decoded signal was formed and lossless encoded, and wherein said lossless encoded difference signal was packed together with said spectral whitening data to form said lossless extension data stream, said method including the steps:

de-packing said lossless extension data stream so as to provide said spectral whitening data;

lossy decoding said lossy encoded data stream, thereby reconstructing said standard decoded signal and, using said spectral whitening data, reconstructing said superior quality decoded signal from said standard decoded signal.

In principle the further inventive decoding apparatus is suited for decoding a lossless encoded source signal data stream, which data stream was derived from a lossy encoded data stream and a lossless extension data stream which together form a lossless encoded data stream for said source signal, wherein said source signal was lossy encoded, said lossy encoding providing said lossy encoded data stream as well as spectral whitening data, and wherein said lossy encoded data were correspondingly lossy decoded, thereby reconstructing a standard decoded signal and, using said spectral whitening data, a superior quality decoded signal was constructed from said standard decoded signal, and wherein a difference signal between said source signal and said superior quality decoded signal was formed and lossless encoded, and wherein said lossless encoded difference signal was packed together with said spectral whitening data to form said lossless extension data stream, said apparatus including:

means being adapted for de-packing said lossless extension data stream so as to provide said spectral whitening data;

means being adapted for lossy decoding said lossy encoded data stream, thereby reconstructing said standard decoded signal and, using said spectral whitening data, reconstructing said superior quality decoded signal from said standard decoded signal.

Advantageous additional embodiments of the invention are disclosed in the respective dependent claims.

DRAWINGS

Figure 4:
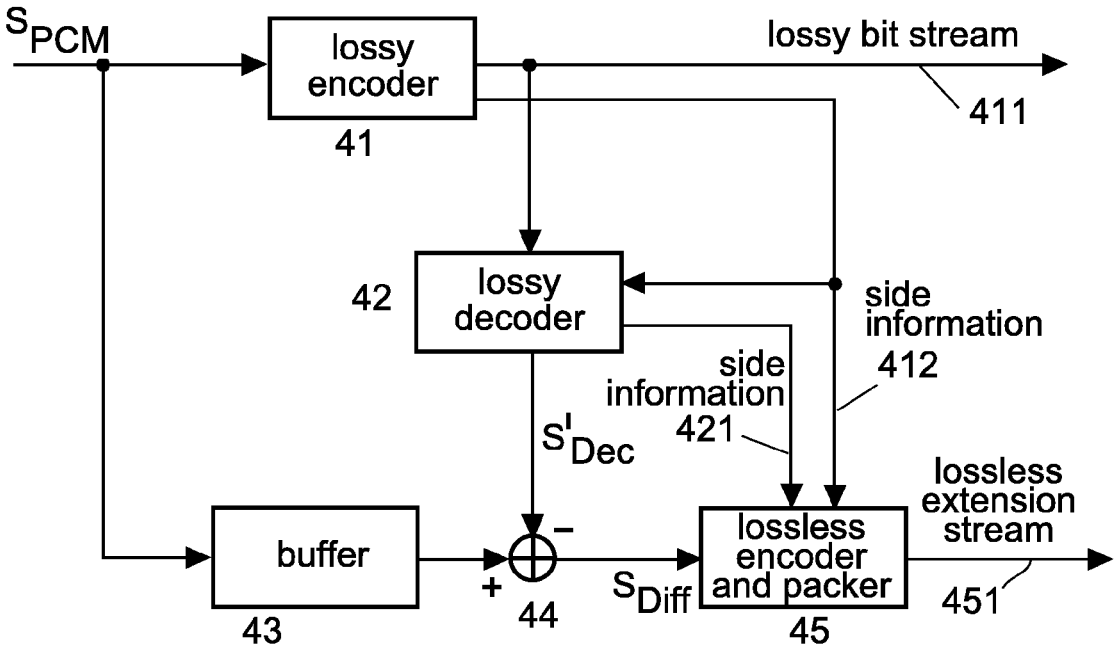
Figure 5:
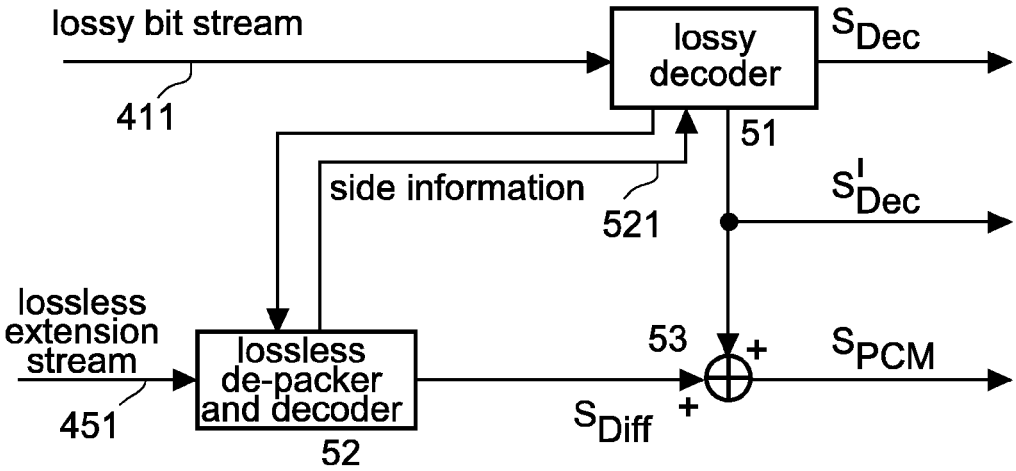
Figure 6:
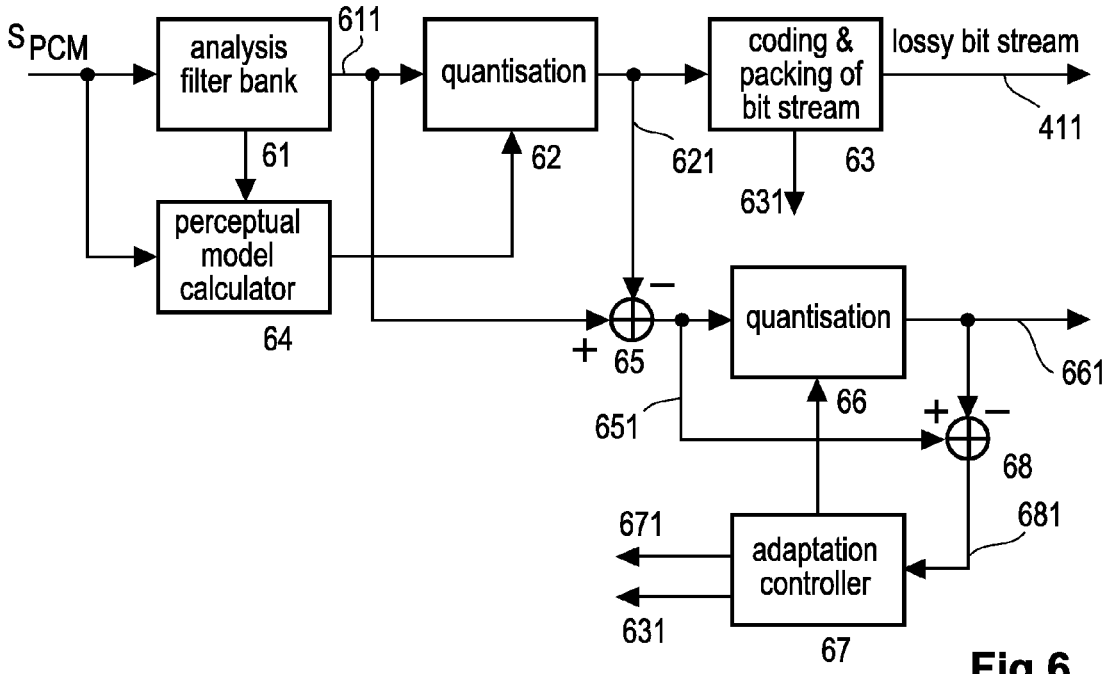
Figure 7:
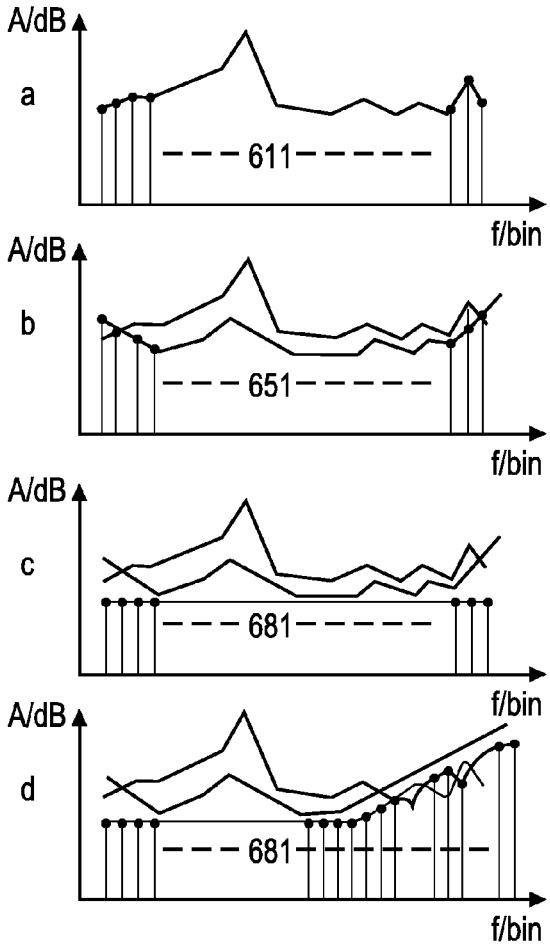
Figure 8:
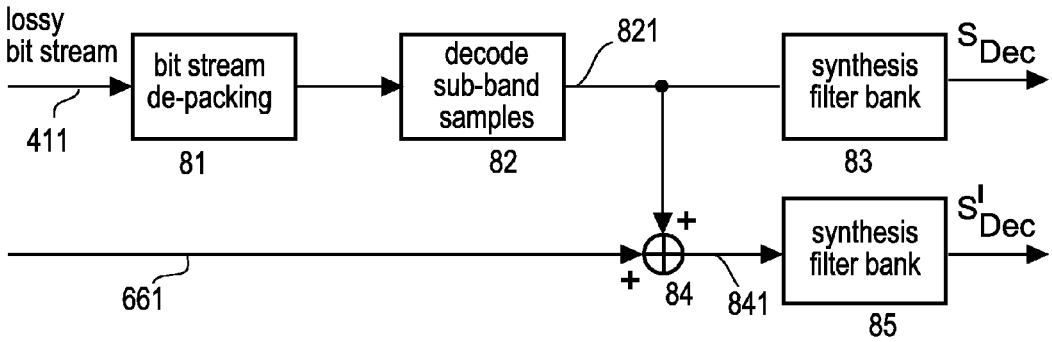
Figure 9:
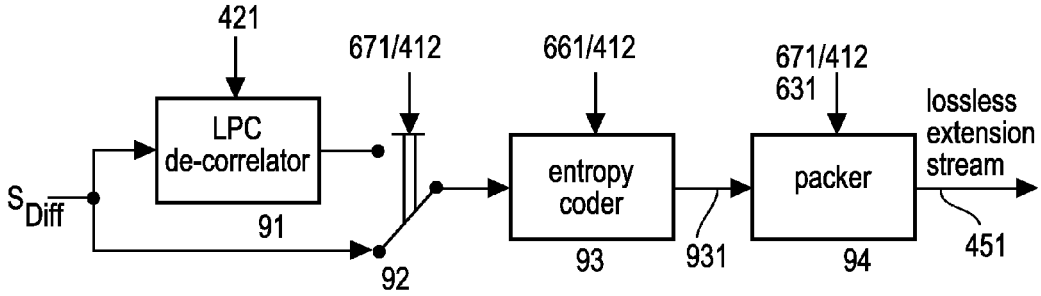
Figure 10:
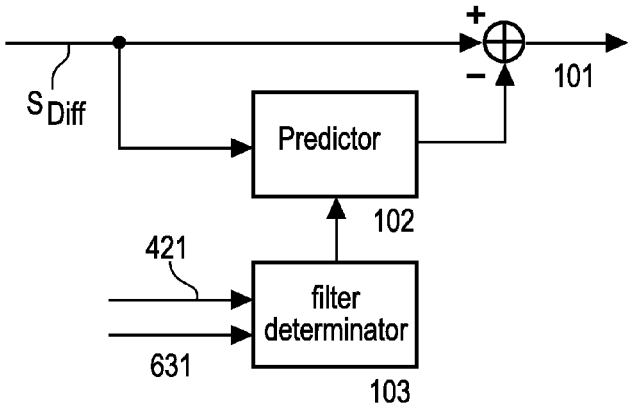
Figure 11:
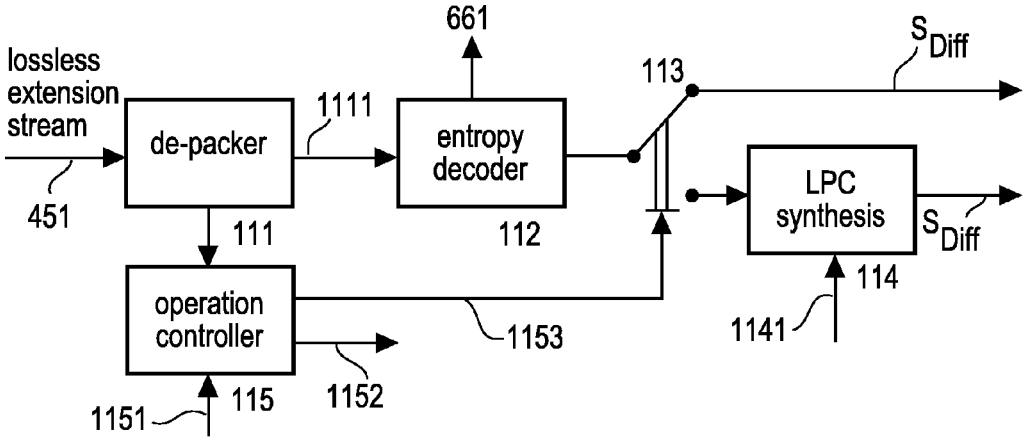
Figure 12:
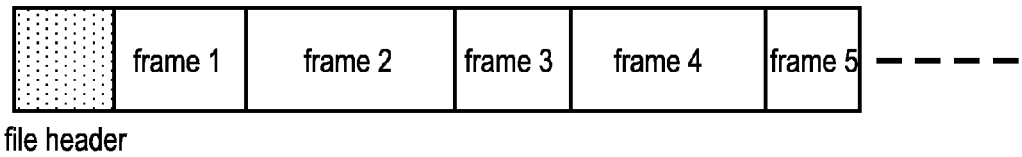
Figure 13:
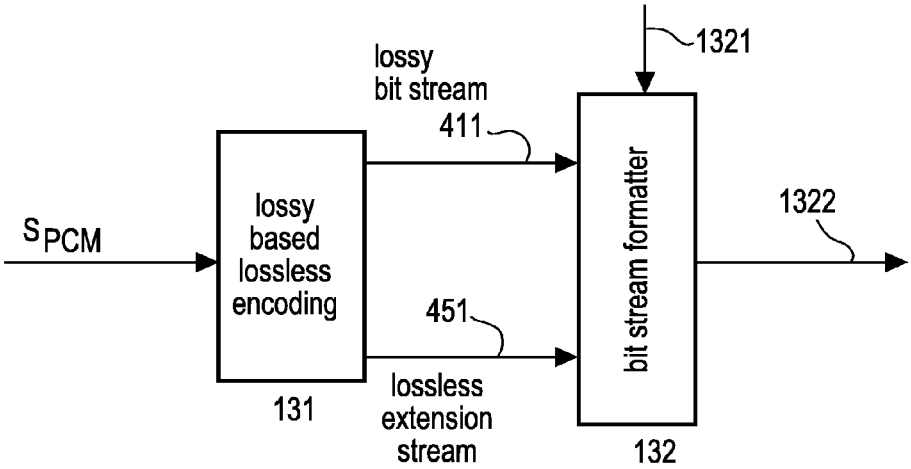

Exemplary embodiments of the invention are described with reference to the accompanying drawings, which show in:

FIG. 1 known principle of lossless audio signal compression;

FIG. 2 basic block diagram for a known lossy based lossless encoder and decoder;

FIG. 3 known principle operation of a lossy encoder and a lossy decoder;

FIG. 4 block diagram for the inventive lossy based lossless encoding;

FIG. 5 block diagram for the inventive lossy based lossless decoding;

FIG. 6 more detailed block diagram for the lossy encoder in FIG. 4;

FIG. 7 example signals:

a) discrete signal spectrum in lossy encoder sub-band domain, b) error signal following perceptually controlled quantisation, c) error signal following whitening, d) spectral noise shaping to adapt to a given LPC filter signal;

FIG. 8 more detailed block diagram for the lossy decoder in FIG. 5;

FIG. 9 more detailed block diagram for the lossless encoder and packer in FIG. 4;

FIG. 10 LPC de-correlator;

FIG. 11 more detailed block diagram for the lossless de-packer and decoder in FIG. 5;

FIG. 12 extension file structure;

FIG. 13 bit stream formatting.

EXEMPLARY EMBODIMENTS

The invention solves the problem of suboptimum de-correlation of lossy based lossless coding by making use of a modified lossy encoder like encoder 41 shown in FIG. 4. Besides of producing from the original input signal $S_{PCM}$ a compliant lossy bit stream 411, this encoder generates special spectral whitening data which is sent, besides other information, as side information 412 to a corresponding modified lossy decoder 42 and to a lossless encoder and packer 45 outputting a lossless extension bit stream. The lossy encoder 41 is shown in more detail in FIG. 6. The spectral whitening data are formed as explained in connection with FIGS. 6 and 7. In the modified lossy decoder 42 the lossy bit stream 411 is decoded and the frequency spectrum for the current frame of the input signal is restored whereby the spectral whitening data from signal 412 is added to the spectrum. Thereafter in decoder 42 a synthesis filter bank is applied, and a time domain error signal $S_{Diff}$ is calculated in a subtractor 44 by subtracting the corresponding decoder 42 output signal $S'_{Dec}$ from the input signal $S_{PCM}$ that has been correspondingly delayed by a buffer 43 in order to compensate for the required processing time in encoder 41 and decoder 42. The error signal $S_{Diff}$ now has a white (i.e. a flat) frequency power spectrum, which is equivalent to having a high de-correlation, and thus is suited for efficient entropy coding. Signal $S_{Diff}$ is fed to a lossless encoder and packer 45 which contains an entropy encoder and includes in its lossless extension stream 451 output lossy encoder side information data 412 provided from encoder 41 and lossy decoder side information data 421 provided by decoder 42.

To increase the lossless coding efficiency, the modified lossy encoder 41 can reduce the amount of whitening data (and thus the related bit rate) in favour of an additional LPC filter placed inside the lossless encoder and packer 45. The LPC filter coefficients are determined using lossy bit stream elements like scale factors or the block spectrum in decoder 42 in the preferred embodiment, and only a very small amount of additional data needs to be transmitted to enable calculation of the filter coefficients at decoder side.

In the lossy based lossless decoding in FIG. 5 the lossy bit stream 411 is decoded in a modified lossy decoder 51 that outputs a (known) lossy encoded and decoded output signal $S_{Dec}$, e.g. a decoded mp3 signal, which may be denoted as lossy mode 1.

When receiving the lossless extension stream 451, consistency to match the lossy bit stream 411 and a permission check to allow decoding for different modes can be performed, e.g. in a lossless de-packer and decoder 52. The different modes can be the lossy mode 1, a lossy mode 2 and a lossless mode 3.

If not operating in mode 1 only, received spectral whitening data is de-packed in means 52 and is sent (among other information) as side information 521 to the lossy decoder 51, in which spectral whitening data is added to the restored spectrum and a synthesis filter-bank is applied to create the output signal $S'_{Dec}$. In lossy mode 2 $S'_{Dec}$ is the output signal. This is a lossy signal which is superior to signal $S_{Dec}$ in terms of perceptual quality and is called 'intermediate quality' in the following description. It is not necessary to decode the lossless encoded difference signal $S_{Diff}$.

In lossless mode 3 the lossless extension stream 451 is further de-packed in means 52 and entropy decoding is applied therein, and an optional LPC synthesis can be applied if signalled correspondingly in the lossless extension bit stream 451. In a preferred embodiment the LPC synthesis filter coefficients are determined using corresponding information items from lossy bit stream 411 data elements like scale factors or the spectrum of related lossy coefficient blocks in sub-band domain of the lossy decoder 51, as well as optional helper information items transmitted inside the lossless extension stream 451. The error signal $S_{Diff}$ is restored in means 52 and is synchronised to signal $S'_{Dec}$. The error signal $S_{Diff}$ and the signal $S'_{Dec}$ (i.e. the intermediate quality signal) are combined in an adder 53 so as to regain the mathematically lossless reconstruction of the original signal $S_{PCM}$.

The lossy decoder 51 operates exactly like lossy decoder 42 in the encoding part in terms of calculation of signal $S'_{Dec}$. Signal $S'_{Dec}$ in the decoding part and signal $S'_{Dec}$ in the encoding part are mathematically identical, as well as signals $S_{Diff}$ in the decoding part and $S_{Diff}$ in the encoding part.

Advantageously, the lossy decoder implementations 51 and 42 and the optional LPC elements in means 52 and means 45 can be realised platform independent using integer arithmetic.

The lossy encoder 41 of FIG. 4 is explained in more detail in connection with FIG. 6. The lossy decoder 51 of FIG. 5 is explained in more detail in connection with FIG. 8. By combining lossy encoder 41 and lossy decoder 42 in FIG. 4, simplifications are feasible.

Lossy Encoder

The lossy encoder 41 includes an analysis filter-bank 61 and a perceptual model calculator 64 which both receive the original input signal $S_{PCM}$. The output signal of filter bank 61 passes to the first input of a subtractor 65 and through a first quantisation means 62 to the second input of a first subtractor 65 and to an encoding and bit stream packing means 63 that provides the lossy bitstream 411. The analysis filter-bank 61 converts signal $S_{PCM}$ into the sub-band domain.

An example spectrum of signal 611 is depicted in FIG. 7*a*, showing the amplitudes A of the spectrum versus the frequency f.

Signal 611 is quantised in the first quantiser 62 according to the control of the perceptual model provided by calculator 64. An error signal 651 is calculated by subtracting the quantised sub-band samples 621 from the original sub-band samples 611. Usually the amplitude of this error signal is proportional to the masking thresholds determined in the perceptual model. An example error signal 651 is depicted in FIG. 7*b* in comparison to signal 611.

The error signal 651 is quantised in a second quantisation means 66 in such a way that a further error signal 681 is calculated within an adaptation control loop formed by a second subtractor 68 and an adaptation controller 67, which further error signal 681 is the difference between signal 651 and the output signal of the second quantiser 66 and approaches a white spectrum, as depicted in FIG. 7*c* together with signals 611 and 651. The output signal of second quantiser 66 represents spectral whitening data 661 that is sent as part of the side information 412 to lossy decoder 42 and to lossless encoder and packer 45. Adaptation control 67 controls second quantiser 66 and takes care to find the right quantisation and the right bit rate for signal 661. If the bit rate exceeds a pre-determined threshold value and the error spectrum 681 is therefore not estimated 'white', within side information 412 an escape signal 671 is sent indicating that the lossless encoder and packer 45 shall use additional LPC de-correlation. Adaptation control 67 sets the optimum quantisation step for quantiser 66 to enable a flat noise floor, see signal 681 in FIG. 7*c*. This control may include a power analysis of signal 651. An iterative process is not necessary.

The second task of adaptation control 67 is to observe an estimation of the bit rate of the entropy encoded signal 661. Signal 661 is later entropy coded in step or stage 93. The bit rate of the entropy coded signal 661 is a main contribution to the overall rate of the 'lossless' bit-stream 451. In case this bit rate estimate exceeds a threshold the escape signal 671 to use additional LPC de-correlation in time domain is sent.

In another embodiment, adaptation control 67 can optimise signal 661 such that signal 681 is no longer white (i.e. it uses different quantisation steps over the frequency bin axis). The noise floor 681 is then formed to match the characteristics of a given LPC de-correlator filter out of a dictionary of different LPC filters. The adaptation control process then becomes iterative in order to find the closest match of signal 681 with lowest costs (i.e. share of bit rate). This embodiment is depicted in FIG. 7*d*.

Lossy Decoder

The lossy decoder 42 shown in FIG. 8 receives lossy bit stream 411 which is de-packed in a bit stream depacker 81 and is decoded (including inverse quantiser scale factor processing if applicable) in a sub-band sample decoder 82 to create a sub-band sample signal 821 which is identical to signal 621 in the lossy encoder in FIG. 6. Signal 821 is transformed back to the time domain in a synthesis filter bank 83 that restores in each case a block of data values of signal $S_{Dec}$. The spectral whitening data 661 (which is received from the lossless extension stream following de-packing) is added in a combiner 84 to signal 821, in order to form a signal 841 that has a quantisation error in the sub-band domain which is identical to the quantisation error of signal 681 in FIGS. 6 and 7*c*. A synthesis filter bank 85 transforms signal 841 back to the time domain and restores in each case a block of data values of signal $S'_{Dec}$. Because normally either signal $S_{Dec}$ or signal $S'_{Dec}$ is output, a single synthesis filter can be used that is connected to either signal 821 or signal 841, respectively.

The lossy decoder should be realised in a platform independent manner using special integer arithmetic operations. Decoding a given bit stream to signal $S'_{Dec}$ within the lossless decoder at encoding or at decoding side needs to produce numerically equivalent results on every platform like ARM based, Intel Pentium based, or DSP based platforms.

Buffer and Synchronisation

Lossy encoding and decoding induces a delay between the signals $S_{PCM}$ and $S'_{Dec}$ in FIG. 4. When operating the lossless encoder in streaming real-time applications the lossy encoder is aware of this delay and will control First-In First-Out buffering in buffer 43 to guarantee sample-exact (i.e. synchronised) operation at subtractor 44 in FIG. 4. When operating the lossless encoder for file-to-file operations, e.g. converting PCM Audio files to lossless encoded files, the buffer 43 can be replaced by using synchronisation means as described in U.S. Pat. No. 6,903,664.

In the preferred embodiment the lossy encoder will insert information items indicating the coding delay and the original file length into the auxiliary data part of the lossy bit stream of the first one or two audio frames as well as into the first frame of the lossless extension. The lossy decoder 42 and 51 will read this information and skip the first decoded (zero) samples indicated by the delay information.

Lossless Encoder and Packer

The lossless encoder and packer 45 of FIG. 4 is shown in more detail in FIG. 9. During regular operation the error signal $S_{Diff}$ is highly de-correlated and can be entropy coded in entropy encoder 93, for which coding the preferred embodiment uses a Golomb-Rice coding. Spectral whitening data 661 (from bus 412) is also entropy coded in encoder 93 using a different entropy coding method, e.g. Huffman coding. The packer 94 forms a frame based bit stream using the entropy coded data 931 and additional information items 412 like escape signal 671 from lossy encoder 41, and outputs the lossless extension stream 451. If indicated by lossy encoder 41 with the escape signal 671, the error signal $S_{Diff}$ can be further de-correlated using a linear prediction in an LPC de-correlator 91, which is shown in more detail in FIG. 10. LPC de-correlator 91 receives helper information from bus 421. The switching according to escape signal 671 (from bus 412) is performed by switch 92.

LPC De-correlator

In the LPC de-correlator in FIG. 10, from the input signal $S_{Diff}$ a version passed through predictor 102 is subtracted in a subtractor 101. Its output signal is fed to switch 92. Predictor 102 uses a filter that is calculated using a filter determinator 103, the filter coefficients of which are derived from the helper information signal from bus 421. Filter determinator 103 can operate as follows:

Mode 1

The scale factors of the decoder are transmitted as signal 421 to filter determinator 103. These scale factors si are used to estimate the spectral power of the residual in the transform domain:

$S_{ee}(i)=2^{-3/8si}$, with i=0, . . . , $N_{band}-1$ (number of bins), whereby the step-like power estimate may become smoothed.

These spectral power values are duplicated to form an even sequence S'ee(i) with i=0, . . . , $N_{band}-1$, . . . , $2N_{band}-1$. This is done to enable a real-valued inverse FFT sequence. Thereafter the auto-correlation is calculated by iFFT ($S'_{ee}(i)$). The Levison-Durbin algorithm can be used to determine the LPC coefficients.

This procedure can also be used in the lossless decoder. If relevant parts of the higher frequency spectrum are not transmitted inside the lossy encoder bit stream 411, this missing information 631 is sent from step/stage 63 in the lossy encoder to packer 94 for transmission, and from de-packer 111 to filter determinator 103.

Mode 2

A set of LPC filter-coefficients is selected from a directory of LPS filter coefficient sets by adaptation controller 67. Then signal 631 becomes the directory index for the selected set of coefficients and is passed to packer 94 for transmission.

Side Information

The side information buses 412 and 421 carry data from lossy encoder 41 to lossy decoder 42 and from either one to the lossless encoder and packer 45, and these buses include the following data elements:

- encoded spectral whitening data 661 (sent via bus 412 from encoder 41 to decoder 42 and to encoder/packer 45);
- an escape signal 671 to indicate additional LPC de-correlation (sent via bus 412 from encoder 41 to encoder/packer 45, i.e. indicating that LPC de-correlation and LPC synthesis is active;
- a helper information signal (sent via bus 421 from decoder 42 to encoder/packer 45 or 94, respectively), i.e. scale factors for LPC filter determination;
- a helper information 631 sent from lossy encoder 41 to encoder packer 45/94, for transmitting missing scale factors for high frequency bands or an index to a set of predefined LPC filter coefficients;
- for file-to-file applications, lossy coder delay value and/or original file length value (sent via bus 412 from encoder 41 to decoder 42 and to encoder/packer 45).

Lossy Based Lossless Decoding

As already described in connection with FIG. 2, the decoding is carried out using a lossy decoder 25 and a lossless decoder 27, the output signals of which are combined to regain the original input signal samples $S_{PCM}$. Advantageously, the decoding can be carried out in different modes.

Mode 1

The decoder can decode any compliant lossy bit stream 411 without a lossless extension stream 451 being present, and provides signal $S_{Dec}$. This mode is also active when a lossless extension stream 451 is present but no permission is provided to use another mode. Preferably, the decoder will check the lossless extension stream for a matching permission ID in its rights data-base.

Mode 2

This intermediate-quality mode is also enabled by a permission check in the decoder when examining the lossless extension stream data. Only the whitening data 661 is de-packed and used by the lossy decoder to provide signal $S'_{Dec}$.

Mode 3

The lossless mode decoding is started following a positive permission check result, and signal $S_{PCM}$ is output.

The corresponding lossy decoder 51 is depicted in FIG. 8 in more detail. The modes of operation are signalled within side information 521 from the lossless de-packer and decoder 52. Basically, the same details apply as described for the lossy decoder 42. The encoded lossy bit stream 411 enters a means 81 for de-packing the bit stream, followed by means 82 for decoding the subband samples and by a synthesis filter bank 83 that outputs the decoded lossy PCM signal $S_{Dec}$. The output signal 821 from means 82 is combined in an adder 84 with the corresponding spectral whitening data 661. The combined signal 841 enters a second synthesis filter bank 85 that outputs the decoded lossy PCM signal S'Dec.

Lossless De-packer and Decoder

FIG. 11 shows the lossless de-packer and decoder 52 in more detail. The lossless de-packer 111 receives the lossless extension stream 451 which is parsed and de-packed.

Control information is routed to operation controller 115 in which in case of file-to-file applications a consistency check can be performed to identify integrity with respect to the lossy bit stream 411. As an option, a reference fingerprint (e.g. CRC data) is extracted from the lossless extension stream 451 and a current fingerprint is calculated over a certain data block of the lossy bit stream 411. If both finger prints are identical the normal operation proceeds. A permission check may be performed as a next step to identify the allowed mode or modes of operation. Corresponding information items 1151 received from an external database are used for comparison with permission identifiers of the received bit stream. The current mode is determined and a corresponding signal 1152 is used to send related information to the lossy decoder 51 using the side information channel 521. In special embodiments, means for deciphering an encrypted lossless extension stream might also be used. Following de-packing, the audio extension signal data 1111 is entropy decoded in an entropy decoder 112. The entropy encoded spectral whitening data items are correspondingly entropy decoded, e.g. in encoder 112. The decoded whitening data 661 is sent to the lossy decoder 51 and the difference signal data $S_{Diff}$ is sent to the combiner or summation unit 53. If escape information to apply additional LPC synthesis is identified in the bit stream 451 by de-packer 111 and operation controller 115, that controller will use signal 1153 to switch switcher 113 to the LPC synthesis path. The coefficients of LPC synthesis filter 114 are calculated using helper information 1141 which is provided from de-packer 111, or which can be determined from the lossy bit stream scale-factors or from the decoder subband signal 841 and additional information transmitted in the lossless extension bit stream 451 like missing scale-factors or spectral power information of high frequency bands not transmitted in lossy bit stream 411, or an index value pointing to a set of pre-defined LPC coefficients.

Side Information

The side information 521 exchanged between lossy decoder 51 and lossless de-packer and decoder 52 includes the following information and data elements:

- a mode indicator signal 1152 (sent to decoder 52);
- spectral whitening data 661 (sent to decoder 52);
- helper information 1141 from lossy decoder 42 to determine LPC filter coefficients (sent to lossless de-packer and decoder 52);
- lossy coder delay value and/or original file length value for file-to-file applications (sent to decoder 52).

Lossless Extension Bit Stream

The following data elements can be provided within the lossless extension bit stream as header data elements:

- a fingerprint to unambiguously identify corresponding lossy bit stream. This element is needed especially for two files applications and might be disregarded for container (one file) and streaming applications;
- mode indicators and corresponding DRM information;
- synchronisation information (lossy coding delay, original file length, file end indicator);
- PCM word size of original signal (16, 20 or 24 bits);
- cue point information enabling a faster addressing of lossless data frames inside the (variable bit rate) stream, consisting of a table of constant frame interval pointers and an frame interval length indicator.

In file-to-file applications these information items need to be provided only once at the beginning of the lossless bit stream. In streaming applications these information items, excluding the cue-point data, need to be sent every N frames.

Frame data elements of the lossless extension bit stream bit stream are:

- a frame boundary indicator to enable frame-synchronous operation for the lossy bit stream;
- coded spectral error (i.e. whitening) data;
- escape information indicating the use of additional LPC synthesis, and LPC helper information;
- the encoded time error signal data.

A lossless extension stream file format is shown in FIG. 12. A file header provides side information to start the process of decoding. Following the header data, data frames of variable length containing data for reconstructing an intermediate-quality audio signal and for reconstructing a lossless-quality audio signal are arranged.

File Header Data:

- header ID;
- header length;
- fingerprint (e.g. CRC32 data);
- mode indication information block;
- side info: codec delay, original file length, PCM word size, sample rate;
- a cue point table data block: block-length value, interval info in frames, number of table entries, pointer-table.

Frame Data:

- sync word (optional) and frame length;
- coded spectral error (i.e. whitening) data: block-length, coded data. This is the data required to decode to intermediate quality (mode 2). Decoders operating in mode 2 will skip the rest of the frame data if such data are present;
- LPC helper information: block length value, LPC mode indicator, coded data;
- coded time error signal: block length value, coded data.

Bit Stream Formats and Rights Management

The lossy bit stream 411 and the lossless extension stream 451 can be formatted for different storage or streaming applications, see FIG. 13. The output signals 411 and 451 of the lossy based lossless encoding 131 are fed to a bit stream formatter 132. The resulting output signal 1322 can be a single stream or file or can consist of two streams or two files. A rights management processing may be applied by supplying formatter 132 with corresponding rights management data 1321.

At decoding side, a corresponding bit stream de-formatter can be used.

The invention claimed is:

1. A method for lossless encoding of a source signal, using a lossy encoded data stream and a lossless extension data stream which together form a lossless encoded data stream for said source signal, said method comprising the steps:

lossy encoding said source signal, wherein said lossy encoding provides said lossy encoded data stream as well as spectral whitening data;

correspondingly lossy decoding said lossy encoded data, thereby reconstructing a standard decoded signal and, using said spectral whitening data, constructing from said standard decoded signal a superior quality decoded signal;

forming a difference signal between said source signal and said superior quality decoded signal and lossless encoding said difference signal;

packing said encoded difference signal together with said spectral whitening data to form said lossless extension data stream, wherein said spectral whitening data are generated by:

processing said source signal in an analysis filter bank and quantizing its output signal and forming the difference signal between the analysis filter bank output signal and the quantization output signal, wherein said quantizing is controlled by a perceptual model calculator;

quantizing said difference signal thereby controlling this further quantization such that the difference signal between the input and the output of said further quantization approaches a white spectrum, whereby the output signal of said further quantization forms said spectral whitening data, and wherein said further quantization is controlled by an adaptation controller that checks the current bit rate of said spectral whitening data and, if said current bit rate exceeds a pre-determined threshold value, sets an escape signal;

and wherein said lossless encoding of said difference signal uses an entropy encoder, the input signal of which passes through an LPC de-correlator only if said escape signal is set.

2. The method of claim 1, wherein said spectral whitening data are entropy encoded.

3. The method of claim 1, wherein said LPC de-correlator is an LPC filter, the filter coefficients of which are determined using scale factors or the spectrum of related coefficient blocks in the sub-band domain of said lossy bit stream or helper information items.

4. The method of claim 1, wherein said lossless extension data stream comprises:

encoded spectral whitening data;

an escape signal indicating that LPC de-correlation is active;

a helper information signal;

for file-to-file applications, a lossy coder delay value and/or an original file length value.

5. A non-transitory storage medium that contains or stores, or has recorded on it, program code which when executed causes a processor to perform the method of claim 1.

6. An apparatus for lossless encoding of a source signal, using a lossy encoded data stream and a lossless extension data stream which together form a lossless encoded data stream for said source signal, said apparatus comprising:

means being adapted for lossy encoding said source signal, wherein said lossy encoding provides said lossy encoded data stream as well as spectral whitening data;

means being adapted for correspondingly lossy decoding said lossy encoded data, thereby reconstructing a standard decoded signal and, using said spectral whitening data, for constructing from said standard decoded signal a superior quality decoded signal;

means being adapted for forming a difference signal between said source signal and said superior quality decoded signal and for lossless encoding said difference signal and for packing said encoded difference signal together with said spectral whitening data to form said lossless extension data stream, wherein said lossy encoding means comprise:

means being adapted for processing said source signal in an analysis filter bank and quantizing its output signal and forming the difference signal between the analysis filter bank output signal and the quantization output signal, wherein said quantizing is controlled by a perceptual model calculator;

means being adapted for quantizing said difference signal thereby controlling this further quantization such that the difference signal between the input and the output of said further quantization approaches a white spectrum, whereby the output signal of said further quantization forms said spectral whitening data, and wherein said further quantization is controlled by an adaptation controller that checks the current bit rate of said spectral whitening data and, if said current bit rate exceeds a pre-determined threshold value, sets an escape signal;

and wherein said lossless encoding of said difference signal uses an entropy encoder the input signal of which passes through an LPC de-correlator only if said escape signal is set.

7. The apparatus of claim 6, wherein said spectral whitening data are entropy encoded.

8. The apparatus of claim 6, wherein said LPC de-correlator is an LPC filter, the filter coefficients of which are determined using scale factors or the spectrum of related coefficient blocks in the sub-band domain of said lossy bit stream or helper information items.

9. The apparatus of claim 6, wherein said lossless extension data stream comprises:

encoded spectral whitening data;

an escape signal indicating that LPC de-correlation is active;

a helper information signal;

for file-to-file applications, a lossy coder delay value and/or an original file length value.

10. A method for decoding a lossless encoded source signal data stream, which data stream was derived from a lossy encoded data stream and a lossless extension data stream which together form a lossless encoded data stream for said source signal, wherein said source signal was lossy encoded, said lossy encoding providing said lossy encoded data stream as well as spectral whitening data, and wherein said lossy encoded data were correspondingly lossy decoded, thereby reconstructing a standard decoded signal and, using said spectral whitening data, a superior quality decoded signal was constructed from said standard decoded signal, and wherein a difference signal between said source signal and said superior quality decoded signal was formed and lossless encoded, and wherein said lossless encoded difference signal was packed together with said spectral whitening data to form said lossless extension data stream, and wherein said spectral whitening data were generated by:

processing said source signal in an analysis filter bank and quantizing its output signal and forming the difference signal between the analysis filter bank output signal and the quantization output signal, wherein said quantizing was controlled by a perceptual model calculator;

quantizing said difference signal thereby con-trolling this further quantization such that the difference signal between the input and the output of said further quantization approaches a white spectrum, whereby the output signal of said further quantization forms said spectral whitening data, and wherein said further quantization is controlled by an adaptation controller that checks the current bit rate of said spectral whitening data and, if said current bit rate exceeds a pre-determined threshold value, sets an escape signal, said decoding method comprising:

de-packing said lossless extension data stream and decoding said lossless encoded difference signal so as to provide said difference signal and said spectral whitening data, wherein said decoding of said lossless encoded difference signal uses an entropy decoder, the output signal of which passes through an LPC synthesis only if said escape signal was set at encoding site;

lossy decoding said lossy encoded data stream, thereby reconstructing said standard decoded signal and, using said spectral whitening data, reconstructing said superior quality decoded signal from said standard decoded signal;

forming from said decoded lossless encoded difference signal and from said superior quality decoded signal a reconstructed source signal.

11. The method of claim 10, wherein said spectral whitening data entropy encoded at encoding site and are entropy decoded at decoding site.

12. The method of claim 10, wherein said LPC de-correlator and said LPC synthesis are an LPC filter, the filter coefficients of which are determined using scale factors or the spectrum of related coefficient blocks in the sub-band domain of said lossy bit stream or helper information items.

13. The method of claim 10, wherein said lossless extension data stream comprises:

encoded spectral whitening data;

an escape signal indicating that LPC de-correlation is active;

a helper information signal;

for file-to-file applications, a lossy coder delay value and/or an original file length value.

* * * * *